US005406893A

United States Patent [19]

Burns

[11] Patent Number: 5,406,893

[45] Date of Patent: Apr. 18, 1995

[54] WORK-STUDY CARREL

[76] Inventor: J. Robert Burns, 11850 Cardwell, Livonia, Mich. 48150

[21] Appl. No.: 212,561

[22] Filed: Mar. 11, 1994

Related U.S. Application Data

[63] Continuation of Ser. No. 950,949, Sep. 25, 1992, abandoned.

[51] Int. Cl.[6] ..... A47B 41/00

[52] U.S. Cl. ..... 108/60; 312/196

[58] Field of Search ..... 108/60, 61; 312/195, 312/196, 240, 241, 272, 272.5, 273, 274, 265.6, 283, 286, 287

[56] References Cited

U.S. PATENT DOCUMENTS

| | | |
|---|---|---|
| 97,483 | 12/1869 | Davis . |
| 380,045 | 3/1888 | Melton . |
| 697,266 | 4/1902 | McDevitt . |
| 1,563,381 | 12/1925 | Larmore . |
| 2,688,525 | 9/1954 | Lindstrom . |
| 2,713,531 | 7/1955 | Boone . |
| 3,117,533 | 1/1964 | Martland . |
| 3,117,534 | 1/1964 | Martland . |
| 3,117,535 | 1/1964 | Hendrickson . |
| 3,181,920 | 5/1965 | Burr . |
| 3,464,372 | 9/1969 | Fiterman et al. . |
| 3,905,484 | 9/1975 | Dean et al. . |
| 3,986,461 | 10/1976 | Steele . |

*Primary Examiner*—Joseph M. Gorski
*Attorney, Agent, or Firm*—Weintraub DuRoss & Brady

[57] ABSTRACT

A work-study cubicle which can accommodate multiple students affords easy teacher supervision and interaction. The cubicle area is separated by at least one slide panel into individual work areas. The panels may be removed to afford larger work spaces. The front area of the cubicle is open to allow eye contact of the study with a teacher. Face-to-face conferences may also be afforded by this cubicle.

5 Claims, 2 Drawing Sheets

FIG 2
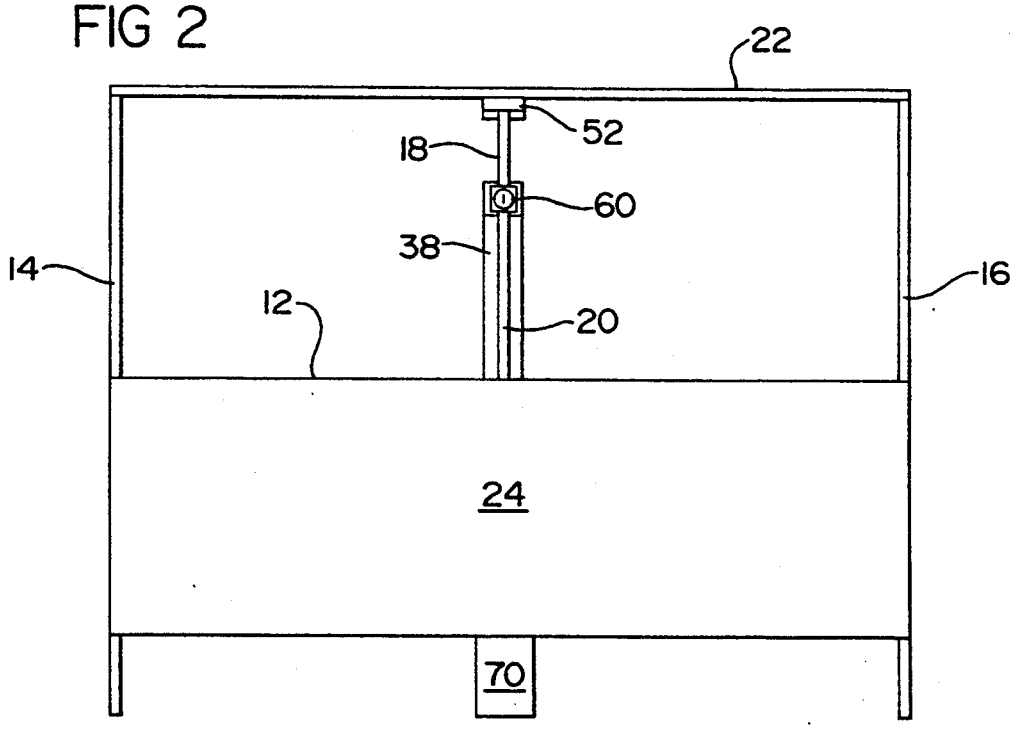
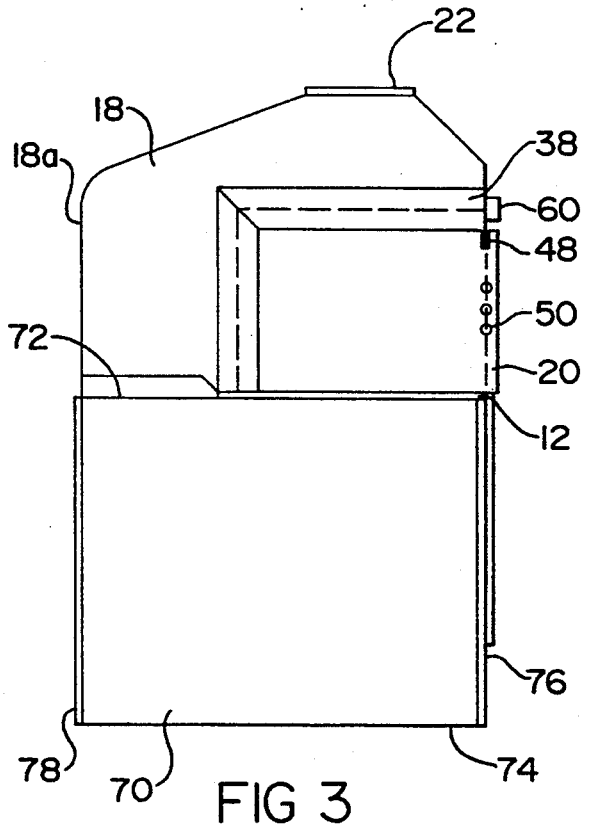
FIG 3
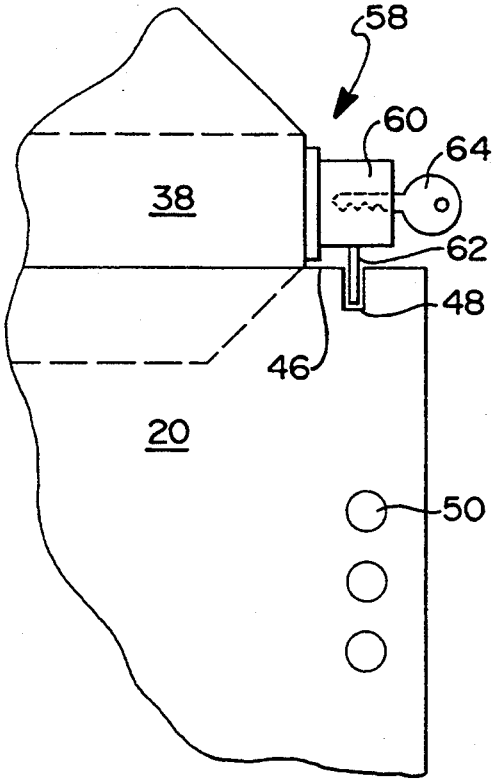
FIG 4

WORK-STUDY CARREL

This is a continuation of the application Ser. No. 07/950,949, filed Sept. 25, 1992, and now abandoned.

BACKGROUND OF THE INVENTION

1. Field of the Invention

This invention relates to the field of classroom furniture. More particularly, the present invention concerns modular study and work stations.

2. Description of Prior Art

Modular work stations for classroom use are well known. Examples of such include foreign language carrels and science laboratory stations.

The classroom stations are commonly equipped with movable/removable panels which extend above-the desk surface of the station. These panels can be easily removed or stored as desired. Typical examples of-these devices are disclosed in the following U.S. Pat. Nos.: 3,117,533; 3,117,534; and 3,117,535. Each of the apparatuses disclosed have similar classroom tables or workstations, having at least one partial panel which extends vertically above the top of the desk. The panels act as dividers between each work station, which can be locked in position. There is no other divider between the persons using the workstation and the panel when it is in an upright, vertical position.

Another example of a workstation is found in U.S. Pat. No. 3,181,920. This reference teaches a modular workstation desk having vertically disposed panels that divide the workstation. The panels are not deposited nor stored below the desk when no longer needed, but fold from an upright position to a flat position onto the surface of the desk. Also, the front panel extends above the desktop forward of the person using the cubicle.

Each of these desks involve extensive problems during their use. Firstly, the only divider between the work stations is the upright panel which extends vertically above the desk. Secondly, when each of the panels are stored into the desktop itself, a portion of the desk is rendered unusable by the gap used for storage or by the divider extending above the surface in a stored position. The folded down divider also limits the use of the desktop as a desk. When it is in a folded down position, except for the limited area of space provided by the surface of the divider, this desk is not usable. Thirdly, the dividers are easily moved by the students or persons using the workstation. This presents problems when it is intended by the instructor that the dividers not be removed. Fourth, there is no other type of divider between the students using the work station to limit interaction between the persons using the work station. There is nothing beneath the desktop nor extended beyond the rear edge of the desktop to prevent the students from interacting with each other. Fifth, the lack of isolation can substantially interfere with the control by the instructor of the learning or teaching environment. Sixth, the above identified units are designed to be used from the rear by both student and instructor.

What is needed is a workstation having an enclosure with extensive student isolation in a teacher-controlled environment, such that the teacher could interact one-on-one with the student and observe several students at the same time. What is further needed is for the workstation to provide a totally usable desktop for joint projects when the dividers between the workstations are removed.

SUMMARY OF THE INVENTION

The present invention is a work-study cubicle designed to overcome the cited problems encountered in the prior art and comprising:

(a) an elongated desktop having a front edge, a first end adjacent to the front edge, a rear edge adjacent to the first edge and substantially parallel to the front edge, and a second edge adjacent to the rear edge and the front edge, the second edge being substantially parallel to the first edge, the front edge, the rear edge, the first edge and the second edge cooperating to define a top surface and a bottom surface of the desktop;

(b) a first support and a second support, the first support being attached to the first edge of the desktop and the second support being attached to the second edge of the disk;

(c) at least one median support attached to the desktop and disposed substantially equidistant between the first and second end supports;

(d) at least one frame having a channel formed, each frame therein, each frame being connected to the desktop and to one associated median support;

(e) at least one slide panel, each slide panel being removably insertable into the channel of one associated frame;

(f) an elongated top panel, the top panel being disposed on the first and second supports and the median support;

(g) an elongated front panel, the front panel being connected to the first and second supports and the front edge of the desktop; and (h) means for locking one individual slide panel into the channel of one associated frame; and wherein the first and second support, the at least one median support, the at least one slide panel, the top panel, and the front panel cooperate to define at least two separate work stations.

The various features, advantages and other uses of the present invention will become more apparent by referring to the following description and drawing are identical reference numbers are used to refer to the same components shown in multiple figures of the drawing, in which:

BRIEF DESCRIPTION OF THE DRAWINGS

FIG. 2 is a front view of the work-study cubicle of the present invention;

FIG. 3 is an end view of the work-study cubicle of the present invention; and FIG. 4 is a partial view of one slide panel and locking mechanism of the work-study cubicle of the present invention.

DETAILED DESCRIPTION OF THE PREFERRED EMBODIMENT

Figure 1:
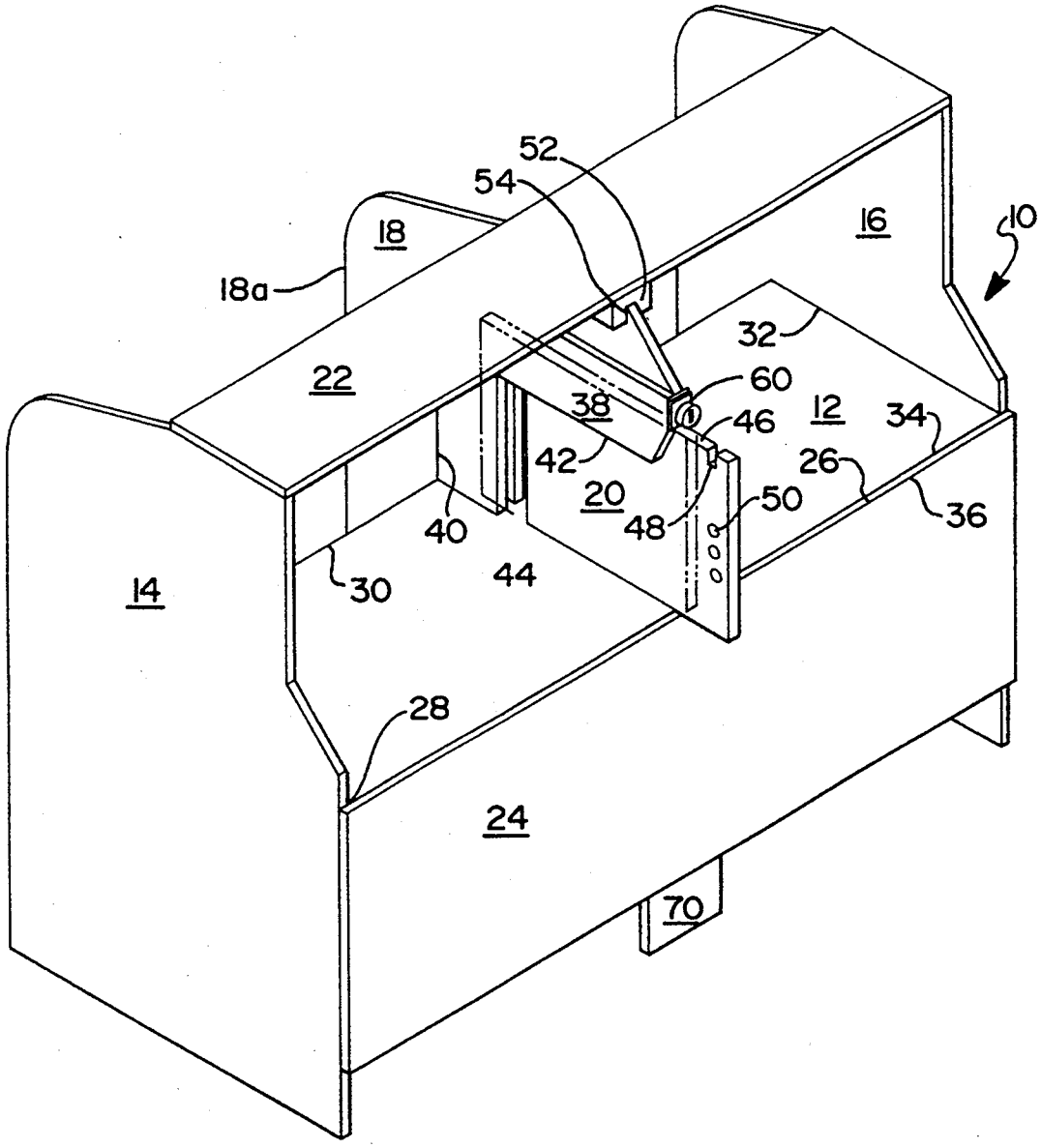
FIG. 1 is the perspective view of a work-study cubicle of the present invention.

Referring now to FIG. 1, there is depicted a preferred embodiment of the present invention, to wit, a work-study cubicle 10. The cubicle 10 comprises an elongated desktop 12, a first end support 14, a second end support 16, at least one median support 18, at least one slide panel 20, an elongated top panel 22 and an elongated front panel 24.

The desktop 12 is formed of wood or other strong material, such as plastic, metal, fiber board, etc. The desktop 12 is substantially rectangular in shape, having a front edge 26, a first edge 28 adjacent to and substantially normal to the front edge 26, a rear edge 30 substantially normal and adjacent to the first edge 28 and substantially parallel to the front edge 26, and a second edge 32 adjacent to and substantially normal with the rear edge 30 and the front edge 26, and substantially parallel to the first edge 28. The front edge 26, first edge 28, rear edge 30 and second edge 32 cooperate to define an upper surface 34 and a lower surface 36 on the desktop 12. The description of the desktop 12 as a rectangular shape is undertaken to teach the preferred embodiment of the present invention, but not to exclude less preferred shapes, such as ovals, trapezoids or squares.

The first support 14 and the second support 16 are planar members formed of a similar material as the desktop 12. The first support 14 is connected to the desktop 12 along the first edge 28 thereof. The second support 16 is connected to the desktop 12 along the second edge 32 thereof. The first support 14 and second support 16 are connected to the desktop 12 by any suitable means, such as gluing or fasteners, such as nails. It is envisioned that releasable fasteners, such as screws, could be utilized. The first support 14 and second support 16 are substantially normal to the desktop 12. The supports 14, 16 hold the desktop 12 above and substantially parallel to the floor (not shown) of the room the cubicle 10 is disposed in.

As can be seen in FIGS. 1 and 2, the cubicle 10 has in its preferred embodiment at least one median support disposed approximately equidistant between the first support 14 and the second support 16. The cubicle 10, in larger embodiments, may have multiple median supports. It is required that the cubicle 10 have at least one median support 18 to divide the desktop 12 into multiple work areas, as will be described herein below.

The median support 18 is formed of the same material as the desktop 12 and the supports 14, 16. The median support 18 is substantially an L-shaped member fixedly attached to the desktop 12 by gluing or other suitable fastening means. The median support 18 is attached to the desktop 12 along-the rear edge 30, such that the base portion of the L-shaped median support 18 is above and substantially parallel to the desktop 12.

At least one frame 38 is deployed and connected to one associated median support 18 and the desktop 12. The frame 38 is an L-shaped member associated with the median support 18 along the outer edge 40 of the frame 38. The inner edge 42 of the frame 38 has a channel 44 formed therein. The bottom of the frame 38 rests on the upper surface 34 of the desktop 12. The frame 38 is formed of wood or other similar sturdy material.

As best seen in FIGS. 1 and 3, at least one slide panel 20 is used and is a rectangular member formed of the same material as the desktop 12. The slide panel 20 is formed to a thickness corresponding to the channel 44 of the frame 38. The slide panel 20 may then be passed into one associated frame 38, so that-the panel 20 is fully seated within the associated frame 38. The panel 20, when deployed, is substantially coplanar with the median support 18 and the frame 38, and being substantially normal to the desktop 12. The slide panel 20 serves to divide the desktop 12 into two areas. If multiple medians 18 and panels 20 are utilized, then additional areas may be formed.

Each slide panel 20 has formed along the upper edge 46 thereof a notch 48. The notch 48 cooperates with means for securing to fix the position of the slide panel 20, as will be discussed herein below. Finger holes 50 are formed in the panel 20 to facilitate disposition of the panel 20. The finger holes 50 may be throughbores or, alternately, depressions in the surface of the panel 20.

A desktop support frame 70 is attached to each median support 18 and extends beneath the desk top 12 between the desktop 12 and the floor. The support frame 70 is a rectangular member formed from the same material as the desktop 12. The support frame has a top side 72, bottom side 74, front side 76 and rear side 78. Each support frame 70 is attached to the associated median support 18 and the desktop 12 by gluing or other suitable fastening means. The rear side 78 of the support frame 70 is aligned with the rear edge **18*a* of the median support 18. The front side 76 of the support 70 is aligned with the front edge 26 of the desktop 12. The top side 72 of tile support frame 70 urges against the lower surface 36 of the desktop 12 with the bottom side 74** of the support frame resting on the floor (not shown).

The top panel 22 is a rectangular member formed of material similar to the desktop 12. The top panel 22 is deployed such that it contacts and is affixed to the first support 14, second support 16 and each median support 18, such that the top panel 22 is substantially parallel to and above the desktop 12. To facilitate contact and securement between each median support 18 and the top panel 22, a block 52 may be deployed therebetween. The block 52 may have a slot 54 formed along the length thereof, such that the median support 18 is seated within the slot 54, as best shown in FIG. 1.

As shown in FIGS. 1 and 2, a front panel 24 may be affixed to the cubicle 10. The front panel 24 contacts the desktop 12 along the front edge 26. The front panel 24 further contacts and is connected to the first support 14 and the second support 16. Where the cubicle 10 would be utilized for seated consultation between student and teacher, it is envisioned that the front panel 20 would be eliminated.

A foot support 56, as shown in FIGS. 1 and 2, may be deployed attached to the lower surface 36 of the desktop 12 for additional support of the desktop 12.

Referring now to FIG. 4, means 58 for securing; the slide panel 20 are shown. The means 58 for securing comprises a lock mechanism 60, a rotating flange 62 and a key 64. The mechanism 60 receives the key 64 into a slot formed therein, as is well known. Turning the key 64 in the mechanism 60 rotates the flange 62, such that the flange 62 is interposed within the notch 48 of the panel 20. The flange 62 prevents withdrawal of the panel 20 from the frame 38. The lock mechanism 60 leaves control of panel deployment to a teacher, and not to student choice. If desired, a mechanism without a lock may be elected. To remove the panel 20, the flange 62 is rotated by turning the key 64.

In use, a student or other person positions themselves on a chair (not shown) within one area divided of the desktop 12 and becomes isolated from a second person at the desktop 12 in the other divided area. With the slide panel 20 in place, neither student is able to communicate or otherwise interact with each other. Under these conditions, the instructor can work with each student one-on-one while keeping the remaining students under observation by working with the student from the front edge 26 of the desktop 12.

Should it be the instructor's desire to have the students in the neighboring workstations to work together, the instructor may unlock the locking means the means for locking and remove the slide panel from its secured position. This then will provide the students at each workstation with a smooth, uninterrupted desktop 12 to work on. If it is the desire of the instructor to return to a one-on-one student/teacher relationship, all the instructor need do is to re-insert the slide panels and lock each in place. Because of the nature of the construction of the work-study cubicle, it is extremely difficult for a student to remove the slide panel or to communicate with each other without sliding their chairs from the workstation and communicating around the rear of the median support.

If it is desirable, the workstation may be provided with means for lighting the work station and an electrical outlet. The classroom teaching requirements will dictate any other additions to the workstation, such as acoustical jacks, etc.

The effectiveness and advantages to this design is to provide an isolated workstation where an instructor may work one-on-one with the students and provide the means by which the instructor may work with two students at the same time or permit the students to work jointly on a project. Also, the design restricts or severely limits the opportunities for the students to interact with each other and become distracted from the learning situation. Certain changes may be made which may become apparent to those knowledgable in the art without departing from the scope from the invention herein involved.

Having thus described the invention, what is claimed is:

1. A work-study cubicle comprising:

(a) a desktop having a first edge and a second edge, a front edge and a rear edge;

(b) a first end support and a second end support supporting the desktop, the first end support being attached to the first edge of the desktop and the second end support being attached to the second edge of the desktop;

(c) at least one median support supporting the desktop, the at least one median support being attached to the desktop and disposed between the first and second end supports, a portion of the at least one median support extending parallel to and above the desktop;

(d) at least one frame disposed between the parallel portion of the at least one median support and the desktop, the at least one frame having a channel formed therein, the at least one frame being matingly configured to a shape of the at least one median support and resting upon the desktop and being connected to the at least one median support;

(e) at least one slide panel, the at least one slide panel being removably insertable into the channel of the at least one frame for dividing the desktop into a plurality of work-study areas, the at least one slide panel being adapted to be locked when in inserted into said channel;

(f) at least one support frame supporting the desktop attached to the at least one median support and the desktop and disposed beneath the desktop;

(g) an elongated top panel, the top panel being disposed upon the first end support, the second end support and the at least one median support;

(h) means for securing the at least one slide panel when disposed in the channel of the frame, the means for securing interposing within the at least one slide panel when securing the at least one slide panel; and wherein the desktop, the first and the second end support, the at least one median support, the at least one slide panel and the top panel cooperate to define a plurality of separate, isolated desktop work-study areas for working and studying thereat, the work-study areas being accessible from the front and the rear thereof.

2. The work-study cubicle of claim 1, wherein the means for securing comprises at least one lock for engaging one of the at least one slide panels;

and wherein the each lock is operable to lock one corresponding slide panel in place when the corresponding slide panel is inserted into one corresponding frame.

3. The work-study cubicle of claim 1, wherein the at least one slide panel further comprises:

a locking notch formed in each of the at least one slide panels, the means for securing being interposable within the locking notch, each locking notch cooperating with the corresponding means for securing the slide panel to lock the slide panel into the associated frame.

4. The work-study cubicle of claim 1, wherein each of the at least one slide panel further comprises:

at least one finger hole formed therein for gripping the at least one slide panel and assisting in removing the at least one slide panel from the associated frame.

5. The work-study cubicle of claim 1 further comprising:

an elongated front panel connected to the first and second supports, the front panel extending downwardly from the front edge of the desktop.

* * * * *